US005099660A

United States Patent [19]

Dostourian

[11] Patent Number: 5,099,660

[45] Date of Patent: Mar. 31, 1992

[54] MOUNTING FOR GEM STONES

[75] Inventor: Jack Dostourian, Richfield, N.J.

[73] Assignee: Douglas Sills, Dobbs Ferry, N.Y.

[21] Appl. No.: 717,861

[22] Filed: Jun. 19, 1991

Related U.S. Application Data

[63] Continuation of Ser. No. 587,446, Sep. 25, 1990, abandoned.

[51] Int. Cl.[5] ..... A44C 17/02

[52] U.S. Cl. ..... 63/28; 63/27

[58] Field of Search ..... 63/26, 27, 28

[56] References Cited

U.S. PATENT DOCUMENTS

| | | | |
|---|---|---|---|
| 630,197 | 8/1899 | Dover et al. | 63/28 |
| 1,440,229 | 12/1922 | Mestekin | 63/28 |
| 1,854,958 | 4/1932 | Santosuosso | 63/28 |
| 4,566,294 | 1/1986 | Brzozowski | 63/28 X |
| 4,819,453 | 4/1989 | McNamara | 63/28 |

FOREIGN PATENT DOCUMENTS

| | | | |
|---|---|---|---|
| 0089906 | 9/1983 | European Pat. Off. | 63/28 |
| 837495 | 11/1938 | France | 63/27 |

*Primary Examiner*—Laurie K. Cranmer

*Attorney, Agent, or Firm*—Levisohn, Lerner & Berger

[57] ABSTRACT

A jewelry article basically comprises a plurality of large round diamonds and small round diamonds with the pavilion portion of the large round diamonds bearing directly upon and overlying, at least a portion, of the crown of the smaller round diamonds such that individually metallic prongs for the diamonds are eliminated. In this manner, the overall brilliance of the structure is increased, greater continuous diamond surface is exposed, less total carat weight is required to provide the same size ring as would be required with individual prong settings and, correspondingly, the cost of the ring structure is decreased.

9 Claims, 2 Drawing Sheets

MOUNTING FOR GEM STONES

This is a file wrapper continuation application of application Ser. No. 07/587,446 filed Sept. 25, 1990, now abandoned.

BACKGROUND OF THE INVENTION

The present invention relates to articles of jewelry containing precious or semi-precious gems. Typically, these articles of jewelry may be manufactured in the form of rings, bracelets, pendants, necklaces, bar pins or the like and include, for example, diamonds, rubies and/or emeralds. The present invention is also applicable to semi-precious or artificial stones. An object of the present invention is to mount gems in a visually pleasing manner to form an attractive piece of jewelry. In the preferred embodiment of the present invention, a ring is formed from substantially 18 carat gold (although platinum or other materials can be utilized) and diamonds as the gem stones. The present invention provides a jewelry article which maximizes the brilliance of the gems while allowing the manufacturer of the jewelry article to reduce the relative cost of the article.

Rings, particularly wedding bands having diamonds which substantially surround the wearer's ring finger, are the easiest to understand and the preferred embodiment of the present invention. For purposes of clarity, the present invention is described with respect to a wedding band ring, although it should be appreciated that the principles and concepts of the present invention can be utilized in connection with any jewelry article wherein a plurality of gems are sought to be mounted and secured in a brilliant-like setting. For purposes of illustrating the present invention, the gems to be secured and mounted are round diamonds which are mounted in a ring made of gold. A means for mounting gems such that no metal prongs are visible between adjacent gems is accomplished. Furthermore, by overlapping smaller gems with larger gems, overall brilliance is enhanced and the space between gems is reduced. This is accomplished by reducing the cost of the ring which is based in large part on the total carat weight of all gem stones and the carat weight of the individual stones.

DESCRIPTION OF THE PRIOR ART

Wedding bands or rings containing a plurality of round gems, preferably diamonds, are extremely attractive. The price of such a wedding band is dependent, in part, on the total carat weight of all of the diamonds. The cost of individual diamonds per carat is dependent upon their overall size, i.e., diamonds are increasingly more expensive per carat as their size increases. For example, a single one carat diamond in round shape is significantly more expensive than the total price of two smaller round diamonds, each weighing one-half carat. Thus, it is an object of the present invention to provide maximum brilliance for a jewelry article while reducing the overall expense of the ring.

Presently, the most preferred manner of mounting diamonds or gems into a jewelry ring setting and, preferably, a wedding band is by the use of a plurality of prongs for each individual round diamond. The prongs serve to support and secure the diamonds in place and allow for the transmission of light from above and below the gems. The manufacture of a wedding band having the necessary number of prongs for all of the diamonds is a labor intensive task. Prong settings impede the transmission of light between adjacently mounted diamonds due to the presence of opaque metal (the prongs themselves) between the diamonds. As a consequence, the overall brilliance and "fire" of the fire are reduced. Thus, it is an object of the present invention to reduce or eliminate metallic prongs between adjacent diamonds by having the diamonds mounted and secured in relative location by overlapping adjacent diamonds.

In an attempt to increase the aesthetic appeal of articles of jewelry it is highly desirable to maximize the viewable and continuous surface area of refractive material, i.e., a continuous surface of diamonds creates an effect that leads the viewer to believe that the overall size of diamonds used is far greater than each individual diamond mounted within the setting. Stated another way, overlapping diamonds in a ring setting by elimination of spacing and prongs increases overall brilliance and creates the impression that diamonds of greater size (and expense) were used than were actually used.

By increasing the size and/or the number of gems mounted on an article of jewelry, larger amounts of gem surface area are created which, in turn, provides the viewer with a perception of greater overall brilliance and fire. However, because diamond pricing is directly related to the total weight (generally, in carats) and to the size and shape of the stones, an increase in the size of the gem stones to provide more gem surface area for viewing can be very cost prohibitive. More specifically, as mentioned, a single one carat diamond is far more costly than two smaller one-half carat round diamonds. Thus, the use of smaller diamonds while maintaining or even increasing brilliance with respect to the use of larger diamonds, is a very desireable object to be accomplished by the present invention.

The present invention is thus directed to increasing the aesthetic appeal of articles of jewelry which are composed of gem stones by decreasing impediments to light transmission between adjacent gem stones. This is accomplished by eliminating the prong-like settings for individual diamonds and using certain of the diamonds, themselves, to support, secure and mount other of the diamonds or gem stones. In this manner, individual prongs are eliminated and light transmission and overall brilliance is increased. In accordance with the invention, building block-like units of small and large diamonds are arranged to provide greater overall brilliance at decreased costs. One or more of the building blocks can be used to form a jewelry article. Thus, the gem surface area exposed or revealed to the viewer is apparently increased while the total carat weight and consequently the overall expense of the gems being used is actually decreased. The instant invention accomplishes these goals while providing a secure support mechanism for mounting gems, namely, diamonds, in articles of jewelry.

SUMMARY OF THE INVENTION

The present invention is directed to a mechanism for mounting gem stones, preferably round diamonds, in articles of jewelry. This invention is intended to increase the transmission of light and create enhanced brilliance by eliminating the normal prong settings for individual round gem stones. The present invention also reduces the spacing between diamonds. The present invention contemplates the use of a larger round gem stone, preferably a diamond, which overlays a small portion of one or two adjacent small round diamonds. The round diamonds are held in place by a series of grooves in the metal portion of the ring and/or an overturned flange which captures the large round diamonds. Thus, the larger overlaying diamond is the principal mounting and securing mechanism for the smaller round diamonds. In addition, by locating the smaller round diamonds immediately beneath the girdle of the larger round diamond, the space otherwise occurring between adjacent diamonds is significantly reduced if not totally eliminated further adding to the overall brilliance of the ring structure.

A lattice matrix, preferably in the form of a series of holes, is constructed to receive the culet portions of the gem stones such that, in the preferred embodiment, the large round diamonds are surround by four smaller round diamonds. The lattice is generally in the form of rectangular openings which are adapted to accept the culet portions of both the smaller diamonds and the larger round diamonds.

According to the principles of the present invention and consistent with the preferred embodiment, the smaller round diamonds are first located in vertically oriented pairs of the rectangular openings in the lattice of the ring and then a single larger round diamond is centrally located in its rectangular opening in between the smaller diamonds. This is the basic building block of the jewelry article, i.e., a single round diamond surrounded, yet overlying, a set of smaller round diamonds. A portion of the girdle of the larger round diamond thus overlays and bears directly on a portion of the adjacently located crown portions of the smaller round diamonds. The jeweler proceeds around the ring, first placing four, i.e., two on each side, smaller round diamonds and then centrally locating and securing the larger diamond. Each larger round diamond thus holds the smaller diamonds in place by overlapping and contacting them. After each large round diamond is located within its rectangular hole of the lattice, a flange portion of the side walls of the ring is bent over the girdle portion of the larger round diamond to prevent accidental removal. The jeweler proceeds, around the entirety of the ring by alternatingly installing smaller diamonds and then larger diamonds.

According to the present invention, prong mountings are entirely eliminated. The pavilions of the large round diamonds rest snugly atop and against the crowns of each smaller gem stone or diamond. The culets of each gem stone or diamond are snugly held by the lattice.

DETAILED DESCRIPTION OF THE DRAWINGS AND THE PREFERRED EMBODIMENT OF THE INVENTION

Figure 1:
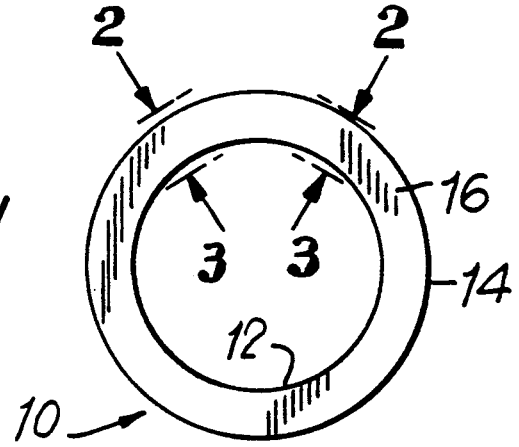
FIG. 1 is a side elevational view of the preferred embodiment of the present invention in the form of a wedding band or ring.

As best seen in FIG. 1, the preferred embodiment of the present invention contemplates a wedding band or ring-like structure 10 which is intended to be worn on the finger of an individual. Of course, it should be appreciated that the present invention and the concepts disclosed herein can be adapted for use in the manufacture and design of pendants, necklaces, bracelets, ear rings, bar pins, etc.

With reference to FIG. 1, a ring 10 is provided with an inside cylindrical surface 12 which is adapted to slide over the wearer's finger and an outside cylindrical surface 14 which displays the gem stones, preferably round diamonds. Two side walls 16 and 18 are also provided and serve to connect, mechanically, inside cylindrical surface 12 to outside cylindrical surface 14.

As best seen in FIGS. 2 through 5, the preferred embodiment of the present invention utilizes round gem stones, preferably diamonds. Each large round diamond 20 is surrounded by four smaller round diamonds 22 which are arranged in vertical pairs. Each pair of small round diamonds 22 is arranged such that the girdles of the small round diamonds just contact one another, as at 23.

The inside cylindrical surface 12 of ring 10 is preferably made from gold or other rigid, non-corrosive metal and is provided with a series of rectangular openings for accepting the culet of the diamonds. The larger rectangular openings 24 (see FIG. 3) are adapted to receive the culet portions 28 of the larger diamonds 20. A pair of smaller rectangular openings 26 are adapted to receive the culets 30 of the smaller diamonds 22. As can be best seen in FIG. 3, each individual larger rectangular opening 24 is surrounded by two pairs of smaller, vertically arranged rectangular openings 26 which provide mounting locations for four smaller diamonds. In this manner, the larger rectangular openings 24 and the smaller rectangular openings 26 provide a matrix or lattice 32 for securing and holding, in relative place, the culets of both the quantity of small round diamonds 22 and the larger round diamonds 20.

Figure 2:
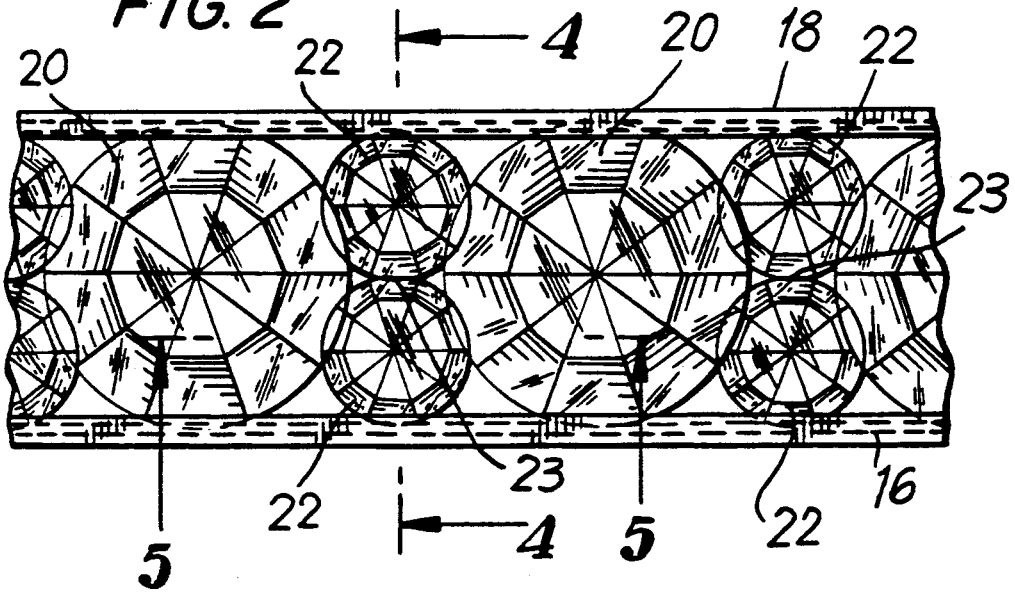
FIG. 2 is a partial top plan view of the ring structure shown in FIG. 1 taken along lines 2—2 thereof.
Figure 3:
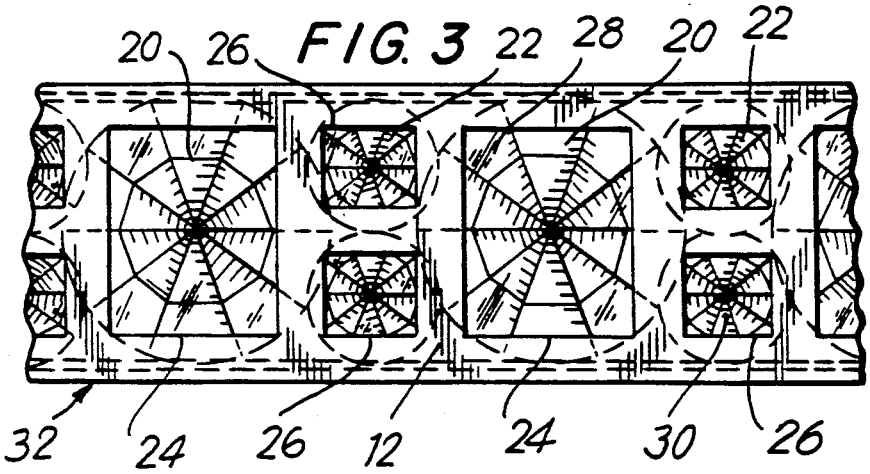
FIG. 3 is a partial inside view, i.e., taken from the center of the ring and looking outwardly, taken along lines 3—3 of FIG. 1.
Figure 4:
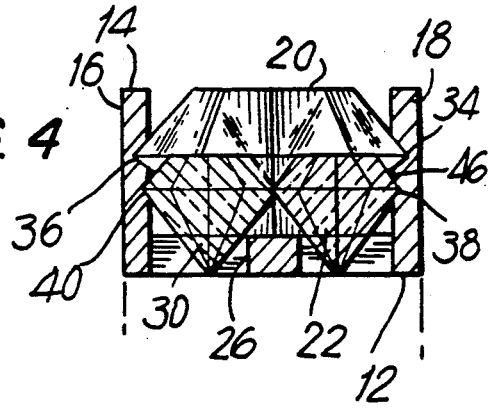
FIG. 4 is a cross-sectional view taken along lines 4—4 of FIG. 2.

Extending upwardly from the inside cylindrical surface 12 or lattice 32 of the ring are a pair of opposed side walls 16 and 18 (see FIGS. 2 and 4). Circumferentially ground or molded into side walls 16 and 18 are at least one and preferably a pair of opposed grooves 34 and 36 for securement of the large diamonds 20. Similarly, circumferentially ground or molded into side walls 16 and 18 are another pair of opposed grooves 38 and 40 for the small diamonds 22. As can be best seen in FIG. 4, the pair of grooves 34 and 36 for the large diamonds are located above, with respect to lattice 32, the pair of opposed grooves 38 and 40 for the smaller round diamonds. The girdle portions of the large diamonds 20 are adapted to be secured within the grooves 34 and 36. Similarly, the girdle portions of the small round diamonds 22 are intended to be pressed down and retained within grooves 38 and 40 located within side walls 18 and 16, respectively. Grooves 38 and 40 can be eliminated, if desired since, as will be discussed, the small diamonds 22 are held in place by the large diamonds 20.

Figure 5:
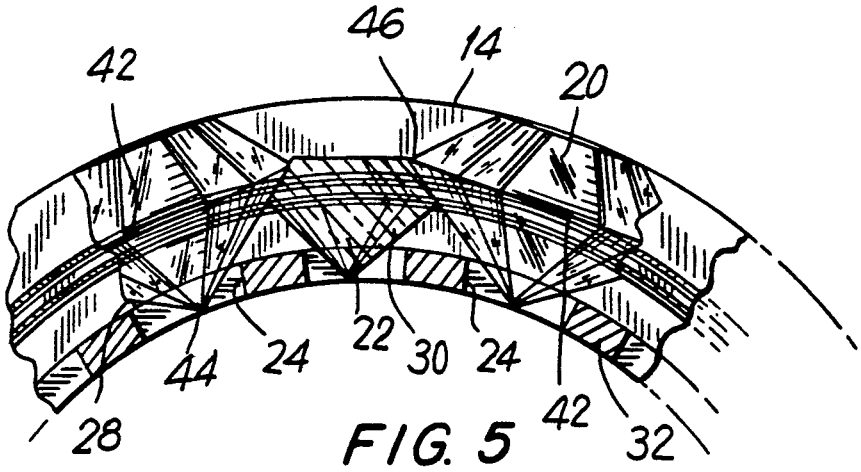
FIG. 5 is a partial cross-sectional view taken along lines 5—5 of FIG. 2.

As can be best seen in FIG. 5, the pavilions of the larger diamonds 20, defined between the girdle 42 and the culet 44, bear down and upon the crown portions 46 of all four of the adjacently located small round diamonds 22. In this manner, the small round diamonds are secured and mounted in the ring without the table of the diamonds being obscured. They are maintained in the ring even where the grooves 38 and 40 are eliminated. Of course, the grooves 38 and 40 along with the pavilion of the large diamonds cooperate to hold the small diamonds securely in place. In addition, by virtue of the pavilion portion of the large round diamonds 20 pressing down and upon the crown portions of the smaller round diamonds 22, air spaces and metal prongs which break up the visual effect have been eliminated to create an overlap of diamond substance and to form a visual appearance of continuous diamond.

In order to assemble the ring of the present invention, the jeweler performs the following:

A lattice 32 or matrix, in the appropriate ring size, is formed from suitable metal, preferably 18 carat gold. The matrix is comprised of a plurality of large rectangular openings 26 each of which is surrounded by two pairs of vertically arranged smaller rectangular openings 26. Of course, the size of the rectangular openings must be appropriate for the size of the culets of the diamonds sought to be mounted and carried by the ring. Then, the jeweler places the culets 30 of four of the smaller diamonds into two pair of adjacent smaller rectangular openings 26. If grooves 38 and 40 are formed into side walls 16 and 18, then the smaller diamonds are pushed down such that the girdle portion of the smaller diamonds are forced into the grooves 38 and 40 of opposed side walls 18 and 16, respectively. The culets 30 of the smaller diamonds are thus located within the smaller rectangular openings with the table or top surface of the smaller round diamonds 22 projecting upwardly toward the top or outside circumferential surface 14 of the ring.

Then, the jeweler places the culet of a single large round diamond 20 into the larger rectangular opening 24, located in between the two pairs of smaller rectangular openings now carrying the smaller diamonds, such that the girdle 42 of the large diamond is pressed down and into the grooves 34 and 36 of the side walls 18 and 16, respectively. The culet 28 of the larger diamond projects downwardly through the large rectangular opening 24 and the table or top surface of the large round diamond projects upwardly, substantially flush with the top or outer circumferential surface 14 of the ring.

The jeweler then either presses or hammers over a small upper portion of the upwardly extending side walls 16 and 18 such that only a small portion (see FIGS. 2 and 4) of the crown of the large round diamond 20 is covered. The large round diamonds are thus protected from falling out of the ring along with grooves 34 and 36 and, yet, substantially the entirety of the table of the round diamonds is visible. The jeweler then turns the ring slightly about its axis and installs two additional small round diamonds into the appropriate pair of smaller rectangular openings 26. Then, as before, the jeweler places an additional large round diamond 20 into the large rectangular opening 24 which is now surrounded by four smaller round diamonds 22. Again, the jeweler folds or hammers down the side walls 16 and 18 so that they overlap, in part, a portion of the crown of the large round diamonds 20.

In this manner, the jeweler proceeds around the entirety of the circumference of the ring to complete a ring structure.

The present invention thus provides for more continuous diamond surface by eliminating spaces between diamonds and metal prong settings. More overall gem brilliance is achieved with use of less total diamond weight. This directly results in lower costs of manufacture since, as mentioned, the cost of diamonds is based on dollars per carat which increases as the weight of the diamond itself increases. For example, a single one carat diamond costs significantly more than two smaller diamonds weighing one-half carat each even though their total carat weight is identical to that of the single larger diamond.

By way of illustration, a ring constructed according to the prior art method of prong setting would be constructed from 23 individual round diamonds weighing 0.09 carats each. The total carat weight of the ring is thus 2.07 carats. According to the concepts of the present invention, however, the same size ring would be constructed of 16 individual large round diamonds weighing the same 0.09 carats each. Thus, the large rounds weigh only 1.44 carats. In addition, 32 small diamonds weighing 0.01 carats each are incorporated, and the total carat weight for the small diamonds is about 0.32 carats. Thus, the ring constructed according to the present invention would have a total carat weight of 1.76 (1.44 plus 0.32) carats compared to the 2.07 total carat weight of the prior art diamond ring having prong settings.

It is thus shown that the present invention provides greater overall brilliance by 1) eliminating the prongs, and 2) significantly reducing the space between the round diamonds (the large rounds actually overlap the smaller diamonds), while actually decreasing the total carat weight. In addition, because a considerable part of the overall carat weight is made up of smaller and significantly less costly diamonds, the entire ring is made more economical.

It is believed that the present invention and the preferred embodiment is fully shown and understood with reference to the above description when considered in connection with the drawings. It can however be used in a wide variety of embodiments and configurations without departing from the inventor's basic contribution. The scope to which the inventor is entitled is determined by the language of the claims as interpreted by the courts.

What I claim is the following:

1. In combination, a jewelry mounting for gem cut stones and gem cut stones held in said jewelry mounting such that the gem cut stones are held in place by other gem cut stones to enhance the aesthetic appeal of the combination, wherein said gem cut stones comprise relatively large and relatively small gem cut stones wherein each gem cut stone has a crown portion, a girdle portion and a pavillion portion the combination comprising:

(a) a bottom support structure for said gem cut stones formed from contiguous metal having an individual opening for holding and providing bottom support for each of said gem cut stones;

(b) a top support for said large and relative small gem cut stones, said top support structure being integrally formed from said contiguous metal and comprising a pair of opposed side walls extending upwardly from said bottom support structure, said side walls having inwardly directed, outside edge-securing means for providing outside edge support to the girdle portions of said large and relative small gem cut stones to form a channel set for said gem cut stones; and (c) the pavilion portion of each of said large gem cut stones bearing directly upon and overlapping the crown portion of each of said associated, relatively small gem cut stones; said overlapping being the means, with said bottom and top support structures, for preventing said relatively small gem cut stones from falling out of said jewelry mounting whereby at least two smaller gem cut stones separate two larger adjacent gem cut stones.

2. The combination of claim 1, wherein said combination comprises a jewelry ring.

3. The combination of claim 2, wherein said gem cut stones comprises at least three large diamonds with small diamonds located between and bearing on each of said large diamonds.

4. The combination of claim 1, wherein said combination comprises a channel set of at least three large gem cut stones with small gem cut stones located between and bearing on each of said large gem cut stones.

5. The combination of claim 1, wherein said gem cut stones are diamonds.

6. The combination of claim 1, wherein said gem cut stones are rounds.

7. The combination of claim 1, wherein said pair of opposed side walls further comprises a pair of inwardly directed opposed grooves, the girdle portion of said smaller gem cut stones being securable therein.

8. The combination of claim 1, wherein said pair of opposed side walls further comprises a pair of inwardly directed opposed grooves, the girdle portion of said gem cut stones being securable therein.

9. The combination of claim 1, wherein said opposed side walls further comprise a flange portion for overlying and securing at least a portion of the crown of said large gem cut stones.

* * * * *